US009468258B2

(12) United States Patent
Ruiz et al.

(10) Patent No.: US 9,468,258 B2
(45) Date of Patent: Oct. 18, 2016

(54) FOOTWEAR INCLUDING COMBINATION LASTING CONSTRUCTION

(71) Applicant: Wolverine World Wide, Inc., Rockford, MI (US)

(72) Inventors: Nelson D. Ruiz, Nashua, NH (US); Marc R. Loverin, Scituate, MA (US)

(73) Assignee: Wolverine Outdoors, Inc., Rockford, MI (US)

( * ) Notice: Subject to any disclaimer, the term of this patent is extended or adjusted under 35 U.S.C. 154(b) by 196 days.

(21) Appl. No.: 14/478,404

(22) Filed: Sep. 5, 2014

(65) Prior Publication Data

US 2015/0257487 A1 Sep. 17, 2015

Related U.S. Application Data

(60) Provisional application No. 61/952,966, filed on Mar. 14, 2014.

(51) Int. Cl.

| | |
|---|---|
| ***A43B 3/30*** | (2006.01) |
| ***A43B 13/28*** | (2006.01) |
| ***A43B 13/42*** | (2006.01) |
| ***A43B 9/02*** | (2006.01) |
| ***A43B 23/02*** | (2006.01) |
| ***A43B 23/07*** | (2006.01) |
| ***A43B 13/14*** | (2006.01) |

(52) U.S. Cl.

CPC ..... *A43B 13/42* (2013.01); *A43B 3/30* (2013.01); *A43B 9/02* (2013.01); *A43B 13/141* (2013.01); *A43B 23/025* (2013.01); *A43B 23/07* (2013.01)

(58) Field of Classification Search

CPC ..... A43B 9/02; A43B 9/06; A43B 9/08; A43B 9/12; A43B 23/025; A43B 23/07; A43B 3/30

USPC ..... 36/18, 19 R, 11

See application file for complete search history.

(56) References Cited

U.S. PATENT DOCUMENTS

| | | | |
|---|---|---|---|
| 8,256,146 | B2 | 9/2012 | Loverin |
| 8,333,022 | B2 | 12/2012 | Crowley, II et al. |
| 8,387,281 | B2 | 3/2013 | Loverin et al. |

(Continued)

FOREIGN PATENT DOCUMENTS

| | | |
|---|---|---|
| FR | 3001616 | 8/2014 |

OTHER PUBLICATIONS

Primigi Footwear (2010).

*Primary Examiner* — Jila M Mohandesi

(74) *Attorney, Agent, or Firm* — Warner Norcross & Judd LLP

(57) ABSTRACT

A footwear construction and related method of manufacture are provided. The footwear can include an upper with a closed liner disposed in an interior of the upper, a flexible Strobel board closing the bottom of the upper and an outsole joined with the upper. The method can include providing an upper having a liner secured thereto, closing an open bottom of the liner with a bottom closure without closing an open bottom of the upper, Strobel stitching a flexible Strobel board to the upper to close the upper bottom, placing the upper with the lining and Strobel board secured thereto on a last and joining an outsole with the upper. The liner bottom closure and Strobel board can be of a thickness and flexibility so that a wearer can perceive movement of the outsole underfoot. Accordingly, the footwear can provide enhanced proprioceptive feedback from a surface being traversed.

19 Claims, 9 Drawing Sheets

(56) References Cited

U.S. PATENT DOCUMENTS

| | | | | |
|---|---|---|---|---|
| 9,072,336 | B2 * | 7/2015 | Borel | A43B 9/02 |
| 2002/0078590 | A1 * | 6/2002 | Collins | A43B 7/06 36/3 R |
| 2004/0074110 | A1 * | 4/2004 | Borsoi | A43B 5/0405 36/50.5 |
| 2008/0127519 | A1 * | 6/2008 | Byrne | A43B 7/06 36/102 |
| 2008/0216358 | A1 * | 9/2008 | Polegato Moretti | A43B 7/08 36/3 A |
| 2008/0244934 | A1 * | 10/2008 | Covatch | A43B 9/06 36/17 R |
| 2010/0319221 | A1 * | 12/2010 | McClaskie | A43B 9/02 36/25 R |
| 2011/0016750 | A1 | 1/2011 | Crowley, II et al. | |
| 2011/0119956 | A1 | 5/2011 | Borel et al. | |
| 2011/0162239 | A1 * | 7/2011 | Bier | A43B 1/04 36/3 B |
| 2012/0011744 | A1 | 1/2012 | Bell et al. | |

* cited by examiner

FOOTWEAR INCLUDING COMBINATION LASTING CONSTRUCTION

BACKGROUND OF THE INVENTION

The present invention relates to footwear, and more particularly to footwear that optionally provides proprioceptive feedback to a wearer's foot.

A variety of footwear exists that cater to the specific needs of a particular user. Sometimes footwear is designed with a particular age group in mind. For example, some footwear are designed for children to assist them in learning to walk, stand, turn and/or climb. Such footwear can be specially constructed for particular age groups of children. For example, pre-school children, ages 2-6 years, generally benefit from footwear that provide natural or complimentary movement of the feet. This allows them to sense—via proprioceptive feedback—the ground, stairs, ladders, bike pedals and varying terrain under their feet. In turn, this provides them with a high level of stability and agility for performing a wide range of activities.

As another example, post pre-school children, ages 6 years and older, as well as adults, also benefit from footwear that provide complimentary movement to allow proprioceptive feedback through the footwear. Such footwear usually aids post pre-school children, as well as adults, in activities including playground activities, rock climbing, wall climbing, balancing, running over varied terrain and the like.

There are a variety of footwear constructions that allegedly enhance proprioceptive feedback to a user's foot. These constructions typically include an upper joined with an outsole. The outsole can be relatively thin so that surface features of the ground underneath can be felt through the outsole to some degree. This type of footwear can include a footbed, which is a piece of cushioning material placed on the interior of the upper generally over the outsole, under a wearer's foot. Many of the constructions including a footbed, however, impair the ability of a child or other user to feel underfoot surface features through the excessive cushioning of the footbed.

In other constructions, the footwear includes a lining disposed in an upper. A firm lasting board is cemented over a bottom piece of the liner. The upper material is pulled to extend completely over the firm lasting board to close the upper. While this effectively closes off the bottom of the footwear, it also adds yet another rigid component (the firm lasting board) immediately under the wearer's foot. In turn, this acts to impair the sensation of forces and features transmitted through the outsole, the lasting board, and the like to the wearer. With this reduced sensation, the user (especially when a child) is not assisted in learning how to walk or otherwise traverse a surface.

Accordingly, there remains room for improvement to provide footwear with an enhanced construction that optionally increases proprioceptive feedback to the wearer.

SUMMARY OF THE INVENTION

A footwear construction and related method of manufacture are provided. In one embodiment, the footwear can include an upper with a closed liner disposed in an interior of the upper, a flexible Strobel board closing the bottom of the upper and an outsole joined with the upper.

In another embodiment, the footwear can include an upper including an interior, an open bottom and an upper lowermost peripheral allowance. A lining can be secured in the interior of the upper. A liner bottom closure can be joined with the liner to close the liner bottom, without closing the open upper bottom.

In still another embodiment, a flexible Strobel board can be joined with the upper lowermost peripheral allowance to close the upper bottom with a Strobel construction.

In yet another embodiment, an outsole can be secured to the upper and Strobel board. Optionally, the outsole can include a proprioceptive configuration to provide enhanced sensory feedback to the wearer of the footwear.

In another embodiment, the Strobel board can define one or more apertures to ensure that the lining is prevented from wrinkling after the Strobel construction is created. Optionally, the apertures can form tabs. The tabs can be movable, for example, foldable, in a direction outward from the remainder of the Strobel board. When folded out, cement can be applied to the temporarily exposed upper surface of the Strobel board. When the tab is folded or otherwise moved to close the aperture, the cement can engage and secure the liner bottom closure to the upper surface of the Strobel board via the tab. Accordingly, the liner bottom closure is not loose in the bottom of the footwear.

In even another embodiment, the proprioceptive configuration of the outsole can include a base that interconnects multiple ground contact pads configured to move relative to one another. Each ground contact pad can move substantially independently of the other ground contact pads relative to the base.

In a further embodiment, the outsole includes a flex portion at least partially surrounding each ground contact pad and attaching each ground contact pad to the base. The flex portion can define a substantially corrugated shape having undulations, allowing each ground contact pad to move substantially independently of the other and relative to the base.

In still a further embodiment, the proprioceptive configuration of the outsole can include a bottom surface that defines multiple nested elliptical grooves substantially in the forefoot region. The bottom surface can define multiple nested, substantially circular grooves generally in the heel region. Further optionally, at least some of the elliptical grooves can intersect at least some of the substantially circular grooves to provide additional multi-axis flexibility.

In yet a further embodiment, a method of manufacturing footwear is provided. The method can include: providing an upper having a liner secured therein, closing an open bottom of the liner with a bottom closure—without closing an open bottom of the upper, Strobel stitching a flexible Strobel board to the upper to close the upper bottom, placing the upper with the lining secured thereto on a last, and joining an outsole with the upper, optionally in the foregoing order.

In even a further embodiment, the liner bottom closure and Strobel board can be of a thickness and flexibility so that a wearer can perceive movement of the outsole under these components. Thus, the footwear can provide enhanced proprioceptive feedback from a surface being traversed by the wearer.

In another further embodiment, the method includes defining an aperture in the Strobel board in one or more locations, before the Strobel board is secured to the upper. The aperture optionally can form one or more tabs that can be moveable, for example via a folding action.

In still another further embodiment, cement can be applied to the Strobel board, optionally when securing the Strobel board and the upper to the outsole. The cement can extend through the aperture, or can be placed on an exposed tab surface of the Strobel board when the tab is moved to an open or exposed position. The tab can be folded or moved closed after cement application. When the tab is closed or moved toward the liner, the previously applied cement can contact or otherwise engage the lower surface of the liner bottom closure or liner in general. This can secure the liner bottom closure to the Strobel board so that the lining is not loose in the bottom of the footwear, and to ensure that the lining is prevented from wrinkling after the Strobel construction is created.

The current embodiment provides a simple and effective footwear construction and related method that are well suited for use with outsoles having proprioceptive configurations, as well as other outsole configurations. Where the footwear includes an inner liner bottom closure and Strobel board that are thin enough to flex, deform and/or move these components sufficiently allow an underlying outsole to transfer forces and sensations from an underfoot surface to the foot of the wearer. In turn, the wearer can attain a greater sensory understanding of the surface, which can enhance their ability to effectively traverse the surface. Where the user is an infant, toddler or young child, the footwear can improve their walking, crawling, standing, turning, cruising and climbing. For example, an infant relies on the sensations felt by their feet to learn to walk. Where the footwear is constructed according to the current embodiments, it promotes, rather than masks, translation of ground contours and contact forces. In turn, this can assist the child in learning to walk while still providing a protective covering over their foot.

These and other objects, advantages, and features of the current embodiments will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT

Figure 1:
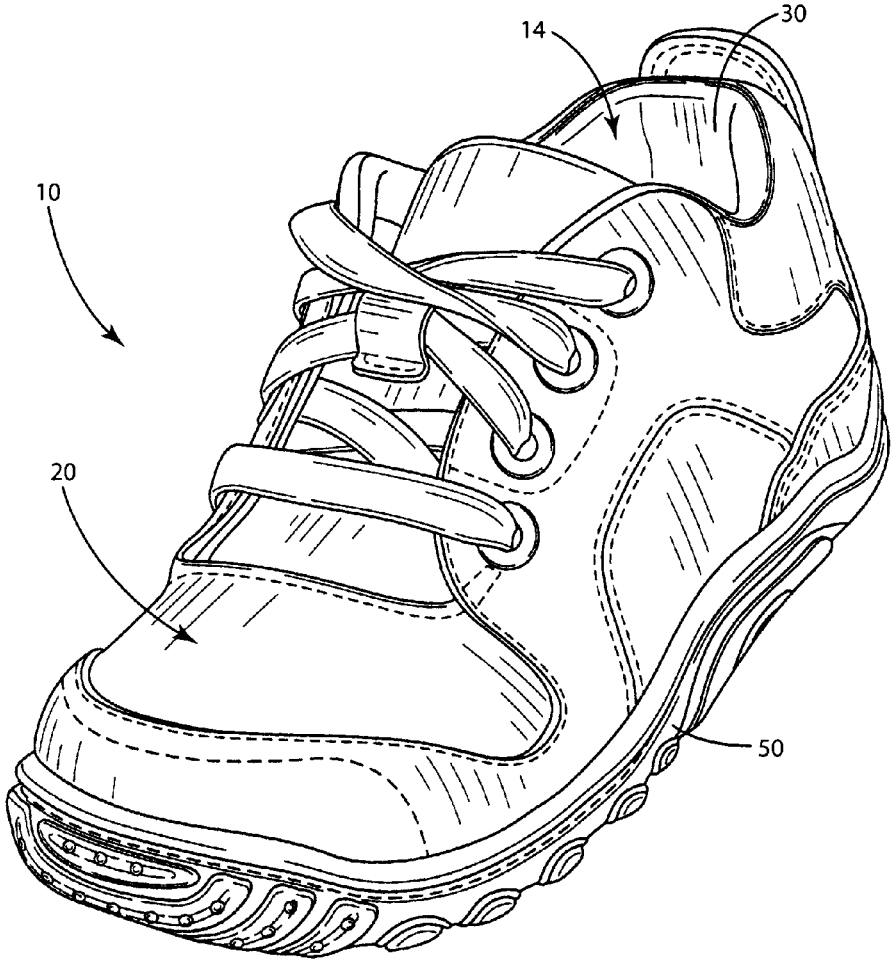
Fig. 1 (Prior Art)
FIG. 1 is a front perspective view of footwear of a current embodiment.

A footwear construction of a current embodiment is illustrated in FIGS. 1-9 and generally designated 10. As shown, the footwear construction can be configured to form footwear for a child, for example, an infant or toddler. This shoe can be constructed to assist the child in learning to walk and develop a gait, crawl, turn and other activities by enhancing complimentary movement and proprioceptive feedback of an underfoot surface. Although described in connection with footwear for younger children, the footwear can also be configured for use by pre-school children, for example 2-6 years old, and post pre-school children, for example over 6 years of age, as well as adults. Such footwear can provide complimentary movement and proprioceptive feedback which can benefit each group in different manners.

Optionally, the current embodiment can be incorporated in any style of footwear, including but not limited to performance shoes, running shoes, athletic shoes, hiking shoes, trail shoes and boots, hiking boots, all terrain shoes, barefoot running shoes, sneakers, conventional tennis shoes, walking shoes, multi-sport footwear, casual shoes, dress shoes or any type of footwear or footwear components.

It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation.

In addition, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear partly within and/or forward of the arch region, lying corresponding to the metatarsals and/or the ball of a wearer's foot; and the term "heel region" (or heel) refers generally to that portion of the footwear rearward of the arch region corresponding to the heel of the wearer's foot. The forefoot region 91, arch or midfoot region 92 and the heel region 93 are generally identified in FIG. 11, however, it is to be understood that delineation of these regions may vary depending on the configuration of the sole assembly and footwear.

Figure 2:
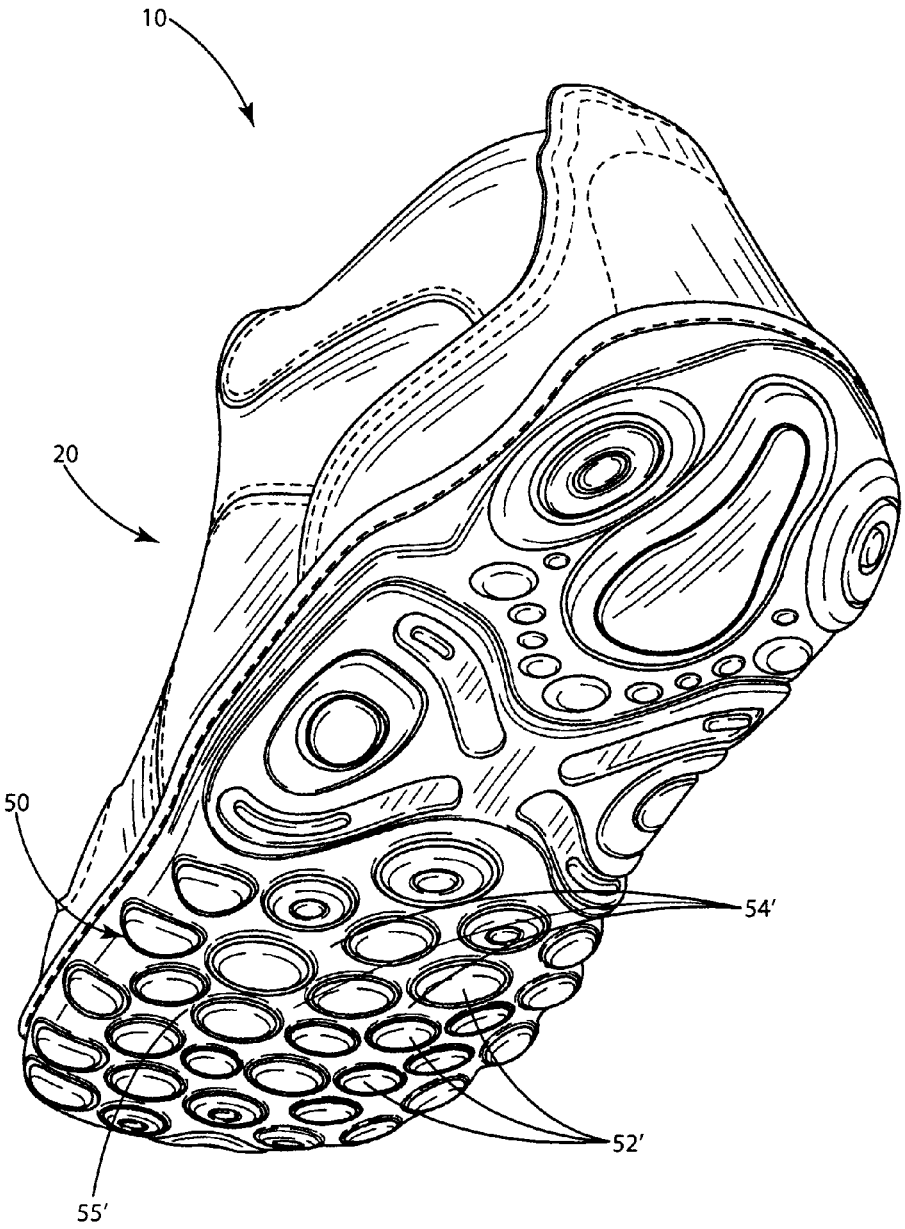
Fig. 2 (Prior Art)
FIG. 2 is a bottom rear perspective view of the footwear, illustrating one type of outsole that can be joined with an upper.

As illustrated in FIGS. 1 and 2, the footwear 10 includes an outsole 50 secured to the upper 20. The outsole and upper can be dimensioned or sized to fit an infant, pre-school child, post pre-school child or adult depending on the desired application. The upper generally includes one or more layers of material that are shaped to form an enclosure or void, also referred to as an interior 14, that is roughly the size and shape of a wearer's foot. The upper 20 can include quarters that form the sides of the upper and a vamp that closes the top of the upper. Foxing, trim or extra material can be added to the upper 20 as desired for functional or aesthetic purposes. Optionally, the upper 20 can include a tongue enclosure system to facilitate fitting and removal of the shoe on a wearer's foot. The upper 20 also can include a heel counter configured to provide control and stability to the wearer's heel.

A lining 30 is attached to the upper 20, and generally disposed on the interior of the upper. This lining can buffer the wearer's foot from the potentially rough inside surfaces of the upper facing the wearer's foot. The lining 20 can be constructed from a soft woven or non-woven material, such as a fabric and/or weaved material. Optionally, the lining 30 can be fastened using stitching, cement or other fastening devices to the upper. For example, the lining can be stitched around the ankle collar 21 and/or along the vamp or quarters in some cases. Before installation of the outsole or Strobel board as described below, this lining 30 can generally rest loosely on the interior 14 of the upper 20.

Figure 9:
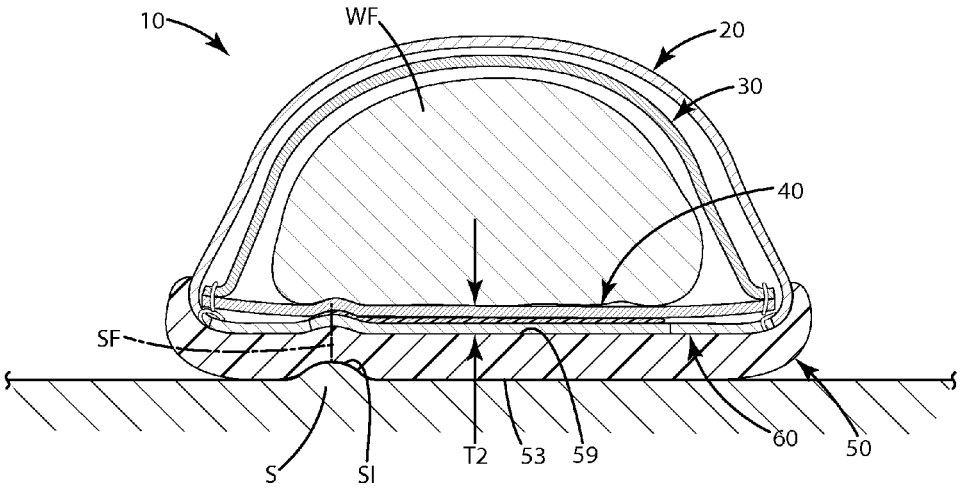
FIG. 9 is a section view of the finished footwear.

As mentioned above, the upper 20 includes an interior 14. The interior 14 generally can be in the shape of the intended wearer's foot WF (FIG. 9). The lining 20 optionally can include one or more side panels 32A and 32B (FIG. 3) joined with one another to cooperatively form the sides, top and/or rear portions of the lining 30. The lining 30 can be specially cut and configured so that it conforms well to the interior 14 of the upper 20 without wrinkling or causing other features that might rub on or feel odd to a wearer.

The upper 20 includes an upper lowermost peripheral allowance 25, which generally terminates at the bottom 26 of the upper. The upper bottom 26 and upper lowermost peripheral allowance form a generally open bottom 27 before attachment of the Strobel board. The open bottom 27 generally is illustrated in FIG. 4.

Figure 3:
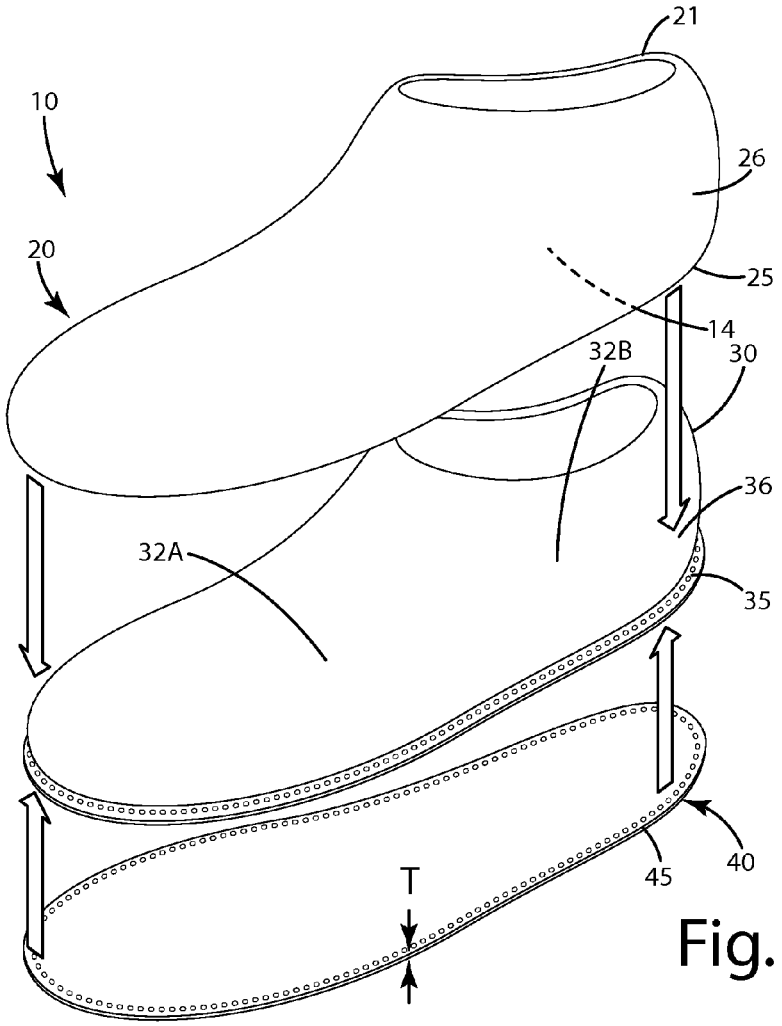
FIG. 3 is an exploded view of an upper, lining and liner bottom closure of the footwear.
Figure 4:
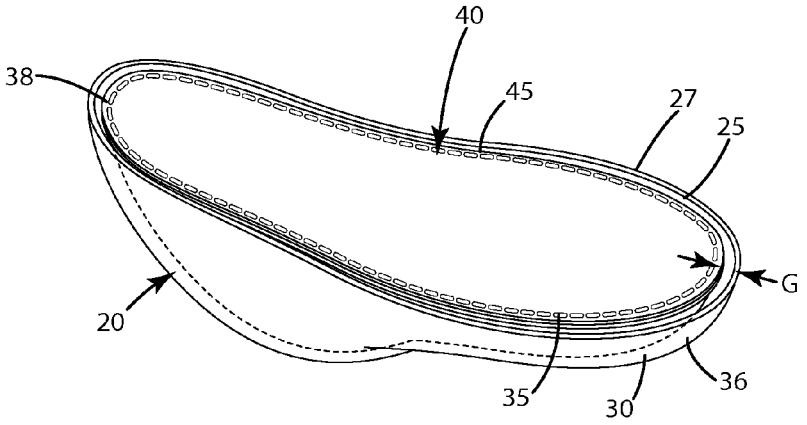
FIG. 4 is a bottom perspective view of the assembled lining and upper.
Figure 5:
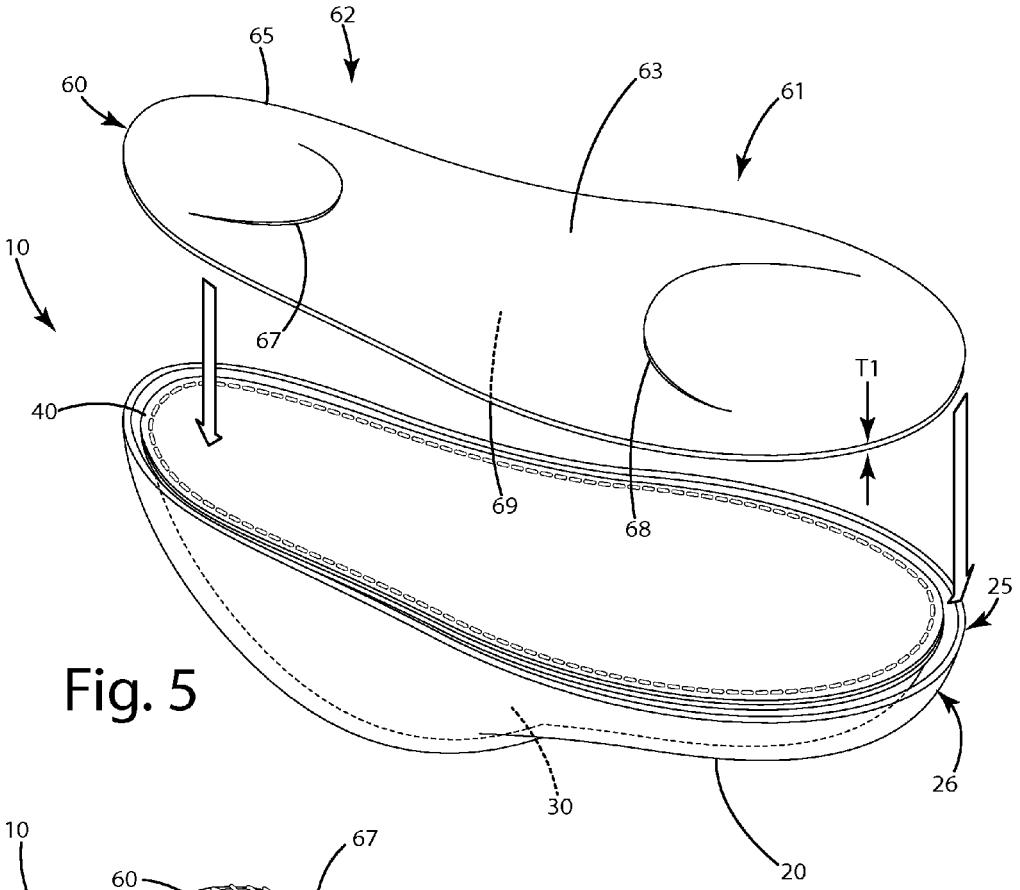
FIG. 5 is an exploded view of the upper and lining with a Strobel board being Strobel stitched to the upper of the footwear.

As shown in FIGS. 4 and 5, the lining 30 can include a lining lowermost peripheral allowance 35. This lining lowermost peripheral allowance 35 optionally can be folded inward or outward to form a flange as shown in FIG. 3. The lining also can include a liner bottom 36 disposed around and generally circumferentiating or surrounding the bottom opening of the liner before it is closed by the liner bottom closure 40. Likewise, the upper 20 can include a bottom 26, which is generally circumferentiated or surrounded by the upper lowermost peripheral allowance 25 as mentioned above.

As shown in FIGS. 3 and 4, a liner bottom closure 40 is joined to the lining 30. This liner bottom closure 40 is joined with the liner bottom 36 and more particularly to the lowermost peripheral allowance of the liner 35. Optionally, the liner bottom closure 40 can be in the form of a nonwoven material. As an example, memory foam constructed from ethyl vinyl acetate, urethane, open or closed cell foams can be utilized to construct the liner bottom closure. If desired, instead of being constructed from memory foam, the liner bottom closure 40 can be constructed from latex, gel or pieces of woven or nonwoven fabric. Generally, the density of the liner bottom closure 40 can be such that it compresses relatively easily to provide cushion to a wearer's foot, readily conforms to the contours of the bottom of the wearer's foot and readily transfers forces from the outsole to the wearer's foot.

The liner bottom closure 40, when formed from memory foam, can be of a thickness T as shown in FIG. 3. This thickness T can be optionally about 1.0 mm to about 5.0 mm, further optionally about 2.0 mm to about 4.0 mm, and even further optionally about 3.0 mm in thickness. Of course, other thicknesses can be selected depending on the particular application.

Optionally, the liner bottom closure 40 can be constructed in the form of a laminate. As an example, the liner bottom closure 40 can include a memory foam core. On the interior facing part of the memory foam core, a face lining can be disposed. This face lining can be in the form of a fabric or other material that is designed to provide an aesthetic feature on the interior of the upper. On a surface of the memory foam core opposite the face lining, a backing fabric can be disposed. This backing fabric generally can hold together the foam and provide some tensile strength to withstand excessive forces or stresses due to flexing movement of the foam or other cushioning material of the liner bottom closure.

The liner bottom closure 40 can include an outer perimeter 45 that approximates the shape of the bottom of the footwear and/or the wearer's foot. This perimeter 45 is fastened directly to the liner bottom 36 at the liner lowermost peripheral allowance 35 to effectively close the liner bottom 36. With this construction, substantially only the ankle opening provides access to the inside or interior of the lining. This fastening of the liner bottom closure 40 can be achieved by stitching the perimeter 45 and the liner bottom closure 40 to the liner lowermost peripheral allowance, again to optionally completely close the liner bottom.

As shown in FIG. 4, the liner bottom is closed with the liner bottom closure 40. In contrast, the upper 20, however, still includes an open upper bottom 26. Put another way, the peripheral allowance 25 of the upper 20 is not attached to the liner bottom closure 40 or otherwise closed off by any other feature before the Strobel board is attached. Accordingly, the liner 30 and liner bottom closure 40 simply rest within the upper 20 without being attached to it, other than with the stitching around the ankle collar 21. The upper 20, and in particular the lower peripheral allowance 25, thereby establishes a gap G between the upper 20 and the lining 30 and/or liner bottom closure 40. This gap can be optionally about 0.001 mm to about 5.0 mm, and further optionally about 0.5 mm to about 3.0 mm around the lower perimeter of the liner bottom closure.

As shown in FIG. 4, the liner bottom 36 is closed with the liner bottom closure 40. The lower peripheral allowance of the upper 25 extending around the outer perimeter 45, or the lining 30 in general, is not attached to the upper 20. Therefore, while the liner bottom 36 is closed, the bottom of the upper 20 still remains open rather than closed. To close the bottom 26 of the upper 20, a Strobel board 60 is joined with the upper lowermost peripheral allowance 25 to close the upper bottom 26 with a Strobel construction.

Generally, the Strobel board 60 can be a flexible, nonwoven, easily deformable and somewhat thin material. The thickness of the Strobel board 60 can be selected so that it can complement the properties of the material and allow a wearer to better perceive movement of different components of the outsole and underfoot surfaces as described below. The thickness T1 of the Strobel board can be selected to provide desired sensory feedback through it and through the memory foam to the bottom of the wearer's foot from the outsole or an underlying surface. For example, the Strobel board can be optionally about 0.1 mm to about 1.0 mm, further optionally about 0.6 mm to about 0.8 mm, and even further optionally about 0.7 mm. Of course, other thicknesses can be selected depending on the particular application. Optionally, the material from which the Strobel board is constructed is very flexible, in which case the thickness might not influence the proprioceptive feedback through the Strobel board.

As shown in FIG. 5, the Strobel board 60 can include an outer perimeter 65 which approximates the shape and size of the bottom of an intended wearer's foot. The Strobel board can also include a forefoot portion 61 and a heel portion 62. These portions or any other portions of the bottom of the strobe Strobel board, can define one or more apertures 67, 68. These apertures can be in the form of U-shaped slits as illustrated in FIG. 5. Other shapes, such as straight lines, curved lines, angled slits, full circular cutouts or other types of apertures can be substituted for the construction shown in FIG. 5. Generally, the apertures can ensure that the lining will not wrinkle after the Strobel board 60 is attached via a Strobel construction to the upper. The apertures can enable a cement 99, which as used herein can be any glue, adhesive, or other sticky chemical compound to permeate, seep or extend through the aperture in the Strobel board and enable the liner bottom closure 40 to be at least partially adhered to the Strobel board, at least in the regions adjacent the apertures. In turn, this can ensure that the lining 30, and generally the liner bottom closure 40 is not loose after the footwear is finished. Optionally, the cement 99 can be applied to the bottom surface 63 of the Strobel board 60 and can penetrate, seep or extend through the apertures 67 and 68 to come into contact with the liner and thereby secure the lining 30, and in particular the liner bottom closure 40, to the upper surface 69 of the Strobel board 60. Generally, this upper surface 69 lays opposite the lower surface 63 of the Strobel board 60.

Figure 6:
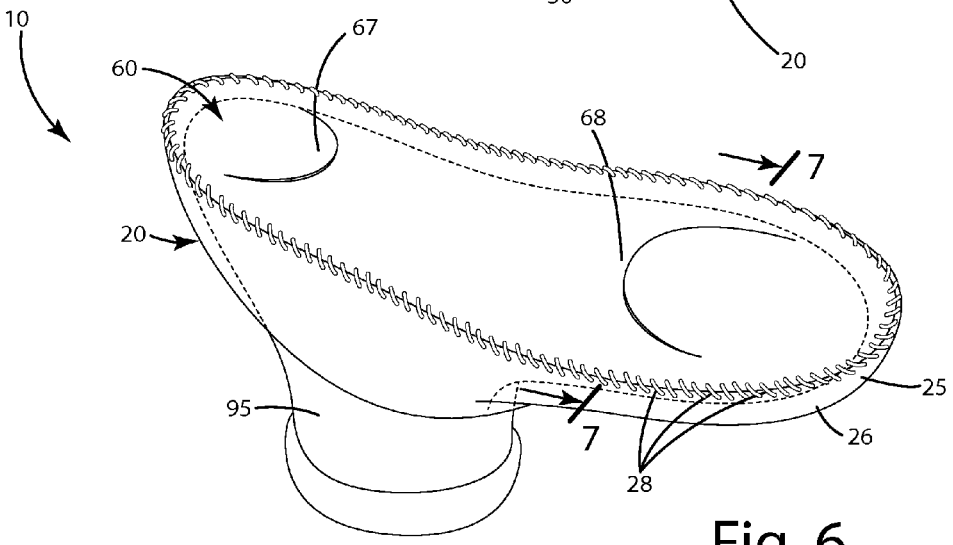
FIG. 6 is a perspective view of the upper secured to the Strobel board and being placed on a last.

The Strobel board apertures 67 and 68 can be linear apertures in the form of lines, slits or slots. They can be of curved "S" s or other configurations. As shown in FIGS. 6 and 7A, the apertures form generally "U" or "V" shaped configurations. With this construction, the apertures generally form or include tabs or flaps. For example, in FIG. 7A, the tab 68T formed by the aperture 68 is generally of a "U" shape. This tab 68T can be foldable or moveable or removable relative to the remainder of the Strobel board. As shown, the tab can be foldable about one or more pivot or movement axes PA. In this manner, the tab 68T can be folded or moved outward, away from the Strobel board 60 and generally away from the bottom surface 43 of the liner bottom closure 40 as indicated by the arrows. When so folded outward, cement can be applied to the upper surface 69 (of the Strobel board 60) which faces toward the liner when the tab is closed which is exposed due to the tab 68T being moved or folded outward. In turn, cement 99 can be used to secure, to adhere or to otherwise secure the Strobel board 60 directly to the liner bottom closure 40 when the tab 68T is moved or folded back toward the plane in which the remainder of the board is located. Optionally, the cement 99 can be directly applied to the lower surface 43 of the liner bottom closure 40 which is exposed through the aperture 68 when the tab is moved or otherwise folded relative to the remainder of the Strobel board 60. Generally, upon application of cement 99, the liner bottom closure 40 is tacked and secured in place in the bottom of the shoe in the area associated with the cement 99 and respective tabs or flaps, so that the liner bottom closure 40 does not wrinkle or otherwise move loosely in the bottom of the upper.

The apertures 67 and 68 can be in several configurations and can be increased in number depending on the particular application. Further, although shown as an aperture with a foldable tab 68T, the apertures 67 and 68 can be in the form of parallel slits along the bottom of the Strobel board. With this slit reconstruction, the central portion of a strip defined between the parallel slits can be raised (by pulling it away from the closure 40), and a cement 99 can be applied thereunder to bond the liner bottom closure 40 to the Strobel board 60.

As mentioned above, the Strobel board 60 is joined with the upper 20 and in particular the upper lowermost peripheral allowance 25 to close the upper bottom 26 with a Strobel construction. Generally, this attachment is facilitated via a stitching of the respective edges of the Strobel board around its perimeter 65. In turn, this generally closes the upper bottom.

Figure 7:
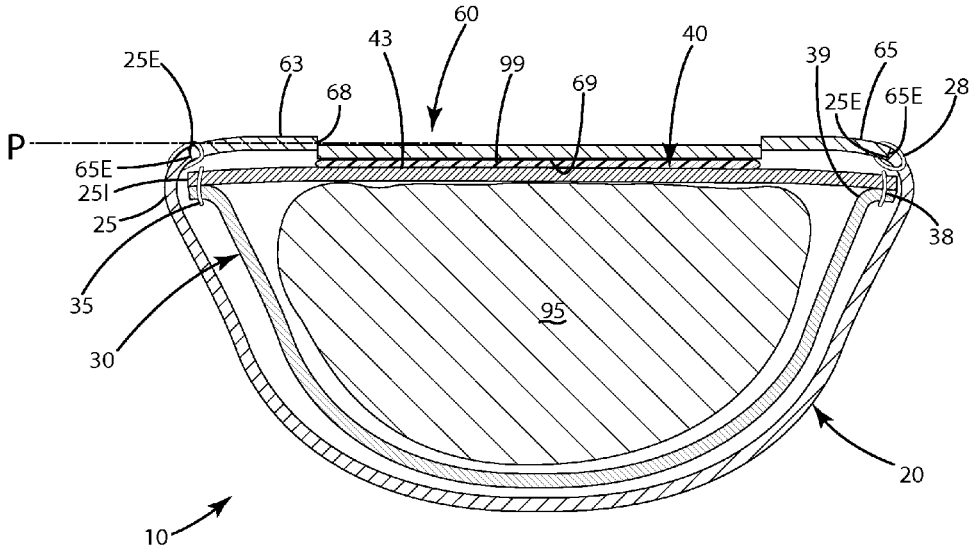
FIG. 7 is a section view of the footwear and last taken along line 7-7 of FIG. 6.
Figure 7A:
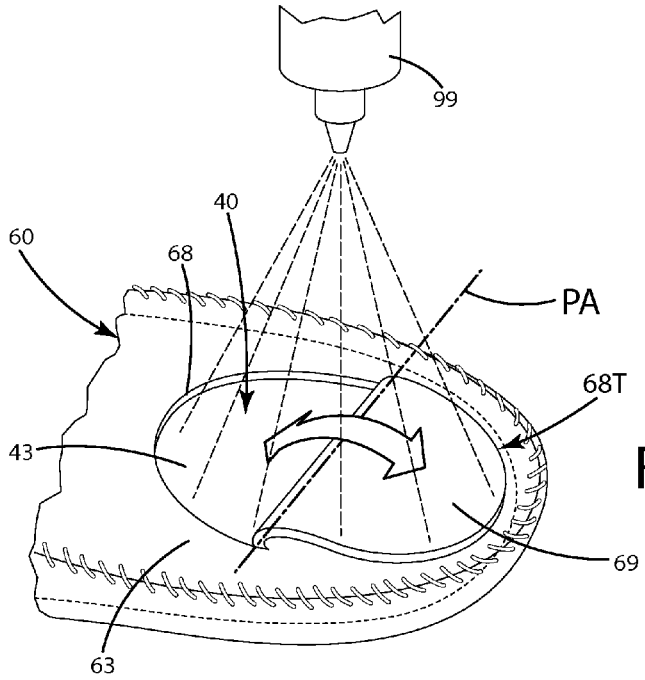
FIG. 7A is a perspective view of a tab associated with the Strobel board of the footwear being moved or folded to open and closed positions.

The Strobel construction is illustrated in the cross section of FIG. 7. There, the upper 20 is attached via the Strobel construction to the Strobel board 60. In this Strobel construction, the lower peripheral allowance 25 is attached to the perimeter 65 of the Strobel board 60. This attachment can be via a stitching 28 that passes through the edge 25E of the lower peripheral allowance and the edge 65E of the Strobel board 60. Optionally, these edges can be squared off or rounded. The stitching 28 can generally be continuous around the entire perimeter 65 of the Strobel board 60 to provide a secure attachment of the Strobel board to the upper lower peripheral allowance and the upper.

As shown in FIG. 7, the edge 65E of the Strobel board 65 lays in the same plane as the edge 25E of the lower peripheral allowance 25 in the Strobel construction. In this manner, the lower surface of the upper can be substantially flush with the lower surface 63 of the Strobel board, and likewise the upper surface 69 of the Strobel board can be substantially flush with interior surface 251 of the lower peripheral allowance 25. This can provide a clean transition between the two components and can reduce wrinkling or buckling when the footwear is flexed. Optionally, the stitching 28, which is used to create the Strobel construction joining the Strobel board 60 with the lower portion of the upper 20 to close the bottom of the upper, is a separate and different stitching than the stitching 38 that joins the liner bottom closure 40 to the liner 30 at the lowermost peripheral allowance 35 of the liner 30. As further shown in FIG. 7, the stitching of the liner bottom closure 40 to the lining 30 creates a clean smooth seam 39 between the liner bottom closure and the lining 30. The seam generally extends around the perimeter 45 of the liner bottom closure 40.

Figure 8:
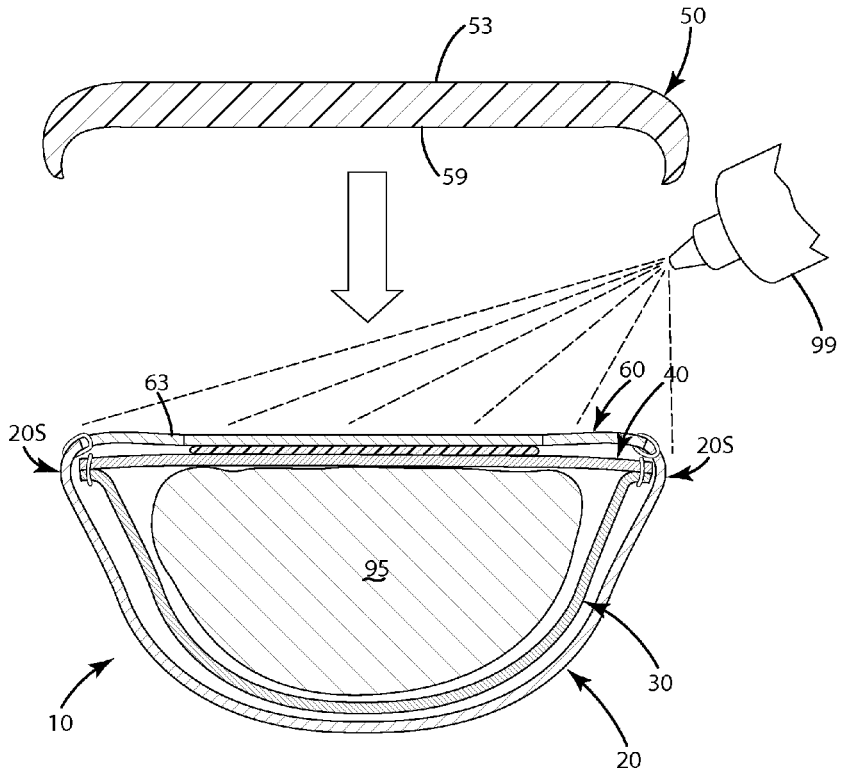
FIG. 8 is a section view of an outsole being cemented to the upper and Strobel board.

The footwear 10 can be outfitted with an outsole 50 as shown in FIGS. 8 and 9. The outsole 50 can be an outsole constructed with a proprioceptive figuration as described below. The outsole 50 generally is joined with the lower part of the combined upper 20 and the Strobel board 60. For example, cement 99 can be applied along the bottom 63 of the Strobel board 60 and along the sides 20S of the upper 20. The outsole 50, and in particular its upper surface 59, can be placed immediately adjacent the bottom of the Strobel board 60 and the sides 20S of the upper 20, with the cement located there between. When it cures, the cement secures the outsole 50 to the Strobel board 60 and the upper 20. Of course, a variety of different patterns for applying the cement 99 can be implemented, depending on the application.

As shown in FIG. 9, the finished footwear 10 includes the outsole 50 secured to the upper 20, with the Strobel board 60 and liner bottom closure 40 generally disposed between the bottom of the wearer's foot WF and the outsole 50, and in particular the upper surface 59 of the outsole. The liner bottom closure 40 and the Strobel board 60 can define a combined thickness T2, which can be the sum of the thicknesses of these components described herein, to enable a wearer to perceive movement of the outsole so that the wearer can be provided with enhanced proprioceptive feedback from an underfoot surface S being traversed.

For example, as shown in FIG. 9, as surface S is traversed, an undulation or surface irregularity SI in the surface can engage the outsole 50. This creates a surface force SF transferred to the outsole which can slightly deform certain localized regions of the Strobel board 60 and/or the liner bottom closure 40. As a result, the surface force SF can be felt directly by the wearer's foot WF along its bottom as illustrated in the direction of the arrow SF. In turn, the wearer can feel or perceive the surface S and its general configuration. Where the wearer is a young child or infant, this can assist them in developing their walking and/or gait. Of course with adults, this can also provide enhanced feedback from an underlying surface over which the adult wearer is traversing.

As mentioned above, the footwear 10 and more particularly the combined upper, lining and Strobel board assembly can be joined with a variety of outsoles. These outsoles can be generally flat outsole, outsoles with tread or lugs, heeled outsoles or other outsoles of virtually any configuration.

One suitable type of outsole is an outsole including a proprioceptive configuration. Outsoles including a proprioceptive configuration are disclosed U.S. Pat. No. 8,333,022 to Crowley, II et al, entitled Articles of Footwear, and U.S. Pat. No. 8,387,281 to Loverin et al, entitled Articles of Footwear, both of which are incorporated by reference in their entirety.

Figure 10:
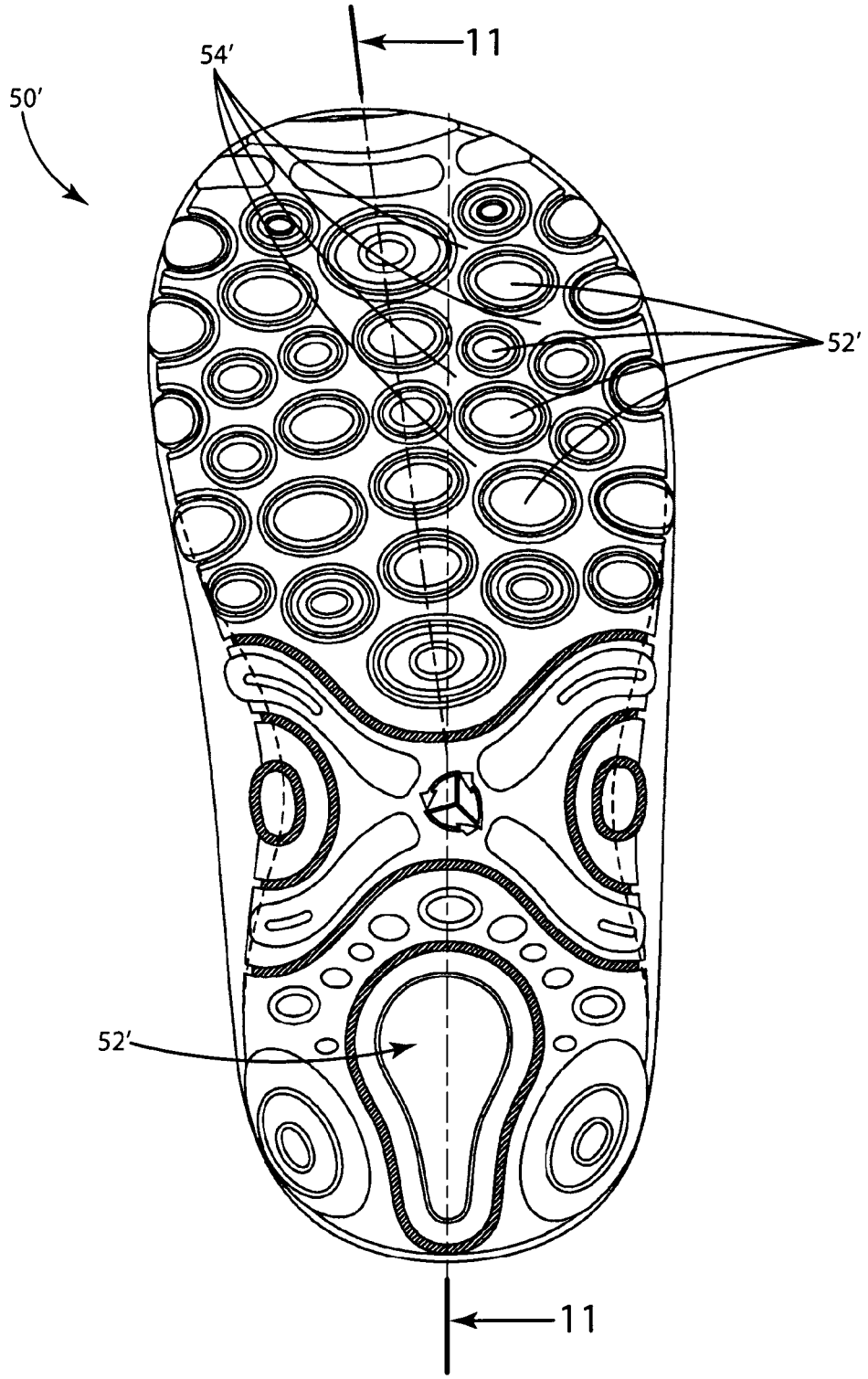
Fig. 10 (Prior Art)
FIG. 10 is a bottom plan view of a first outsole including a proprioceptive configuration.
Figure 11:
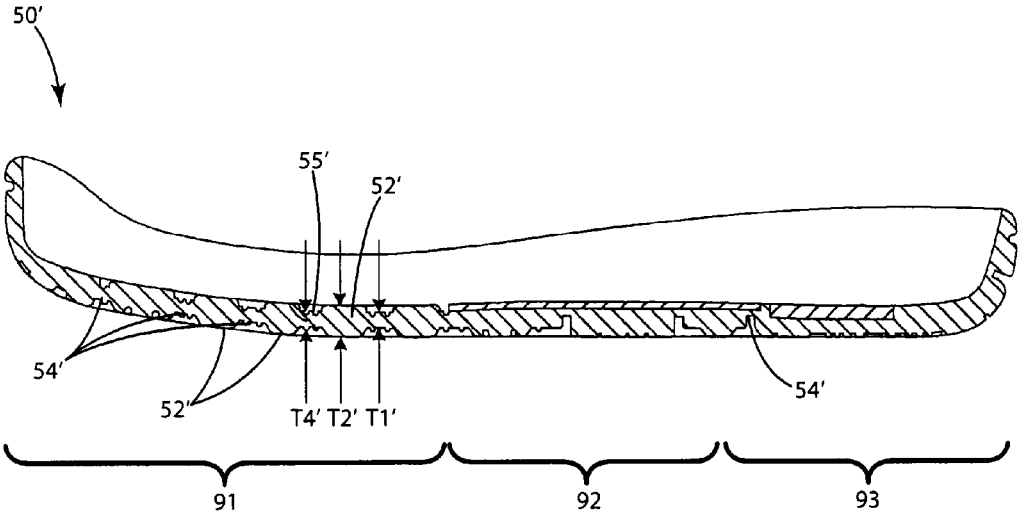
Fig. 11 (Prior Art)
FIG. 11 is a cross section view of the first outsole taken along lines 11-11 of FIG. 10.

An outsole with a proprioceptive configuration is illustrated in FIGS. 10 and 11 and generally designated 50'. This outsole 50' includes a forefoot region 91, an arch region 92 and a heel region 93, with the arch region 92 generally being disposed between the heel and forefoot regions. The forefoot region 91 of the outsole can be constructed to be very flexible, pliable and compliant, allowing complementary movement and tactile sensation of an underfoot surface through the footwear 10. This ability to feel the underfoot surface through the footwear 10 allows a wearer to receive proprioceptive feedback of that surface through the outsole 50'. Again, such proprioceptive feedback can be beneficial for infants and toddlers when learning to walk, developing a proper gait, or other activities such as crawling, turning, climbing and the like.

The proprioceptive configuration of the outsole 50' is designed to allow the user to experience the contours of an underfoot surface and feel localized forces across the outsole 50', for example, in the forefoot region 91 and/or heel region 93 in particular. This can aid in the development of proper gait and feel of the ground surface for balance while performing particular activities.

As shown in FIG. 10, the outsole 50' includes one or more ground contact pads 52' configured to move with respect to one another and/or relative to a common base 54'. The ground contact pads 52' translate forces, incurred by the ground contact pads from an underfoot surface upon which the outsole is positioned, to the wearer's foot WF. In turn, this enables the wearer to experience relatively greater proprioceptive feedback from the underfoot surface being traversed. For example, the ground contact pads 52 can enable a wearer to feel localized forces across the foot in one or more regions.

The ground contact pads 52' can be elliptical in shape, but may be of any shape, such as circular, rectangular, polygonal, or the like, and can be of various thicknesses and sizes. Relatively larger ground contact pads 52' may be positioned under locations in the foot that generally experience larger impact forces, or more contact frequency, for example, under the ball of the foot. Relatively smaller ground contact pads can be positioned under areas of the foot that experience relatively smaller impact forces, or less contact frequency, thereby providing localized load points for sensory feedback to the wearer's foot WF.

As illustrated in FIG. 11, the ground contact pads 52' are connected or joined with the base 54' in a manner that allows each ground contact pad 52' to move relative to one another, substantially independently and optionally, relative to the base portion 54'. The ground contact pads 52' can be moved in any direction, for example, as the forefoot region 91 bends, twists or otherwise moves. Optionally, a flex portion 55' can connect one or more ground contact pads 52' to the base 54'. This flex portion can be configured to allow the ground contact pad 52' to better move relative to the base portion 54'.

As illustrated in FIG. 11, the base 54' of the outsole includes a thickness T1' that is less than thickness T2' of the ground contact pads 52', and less than a thickness T3' of the mid or arch region 92 of the outsole, to provide greater flexibility in the forefoot region 91 as compared to the arch region 92 and optionally the heel region 93. As also shown in FIGS. 10 and 11, the flex portion 55' at least partially surrounds or circumferentiates each respective ground contact pad 52' in the base 54'. Optionally, the flex portion 55' has a thickness T4' that is less than the base portion thickness T1' and the ground contact pad thickness T2'. This allows the flex portion 55' to bend more easily than the other portions. Further optionally, the flex portion 55' can comprise an elastic material such as rubber. Where the flex portion 55' is relatively thinner, it elastically deforms more easily than other portion of the forefoot region 91 and allows better ground contact pad movement and movement of the outsole in general.

As further shown in FIG. 11, the flex portion 55' can include a substantially corrugated shape, and/or can have one or more undulations to facilitate bending and flexing thereof, and movement of the associated ground contact pad 52'. The undulations of the flex portion 55' also can aid vertical movement of the ground contact pad 52' with respect to other ground contact pads and/or the base 54'. Some examples of the flex portion can include a groove or recess defined by the base portion 54' surrounding at least a portion of the respective ground contact pad.

Figure 12:
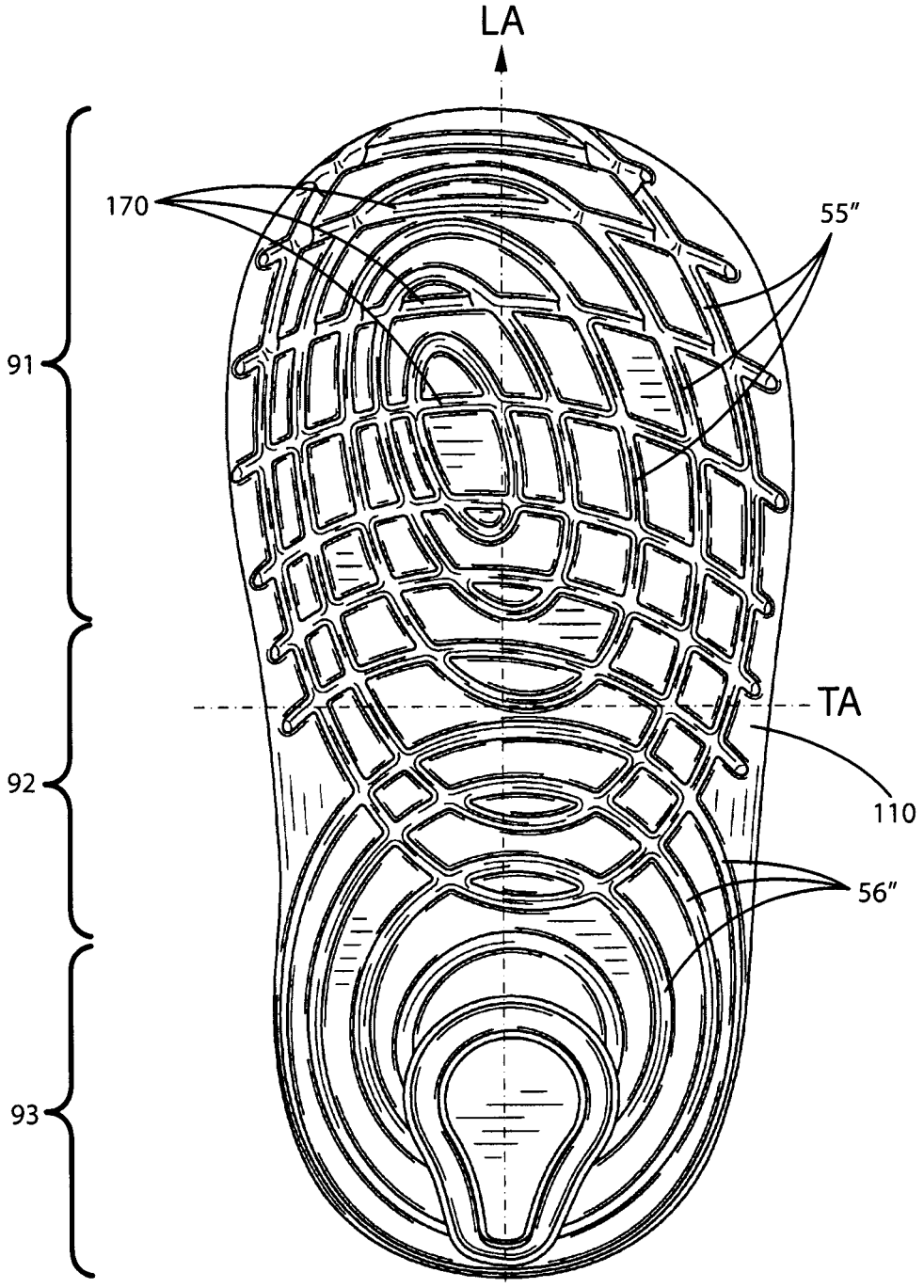
Fig. 12 (Prior Art)
FIG. 12 is a bottom view of a second outsole having another proprioceptive configuration.

Another outsole with a proprioceptive configuration suitable for use with the footwear 10 of the current embodiment as illustrated in FIG. 12. This outsole 50" can include a proprioceptive configuration having multiple nested elliptical grooves 55" located substantially in the forefoot region and/or arch region of the footwear of the outsole. The bottom surface optionally can define multiple nested substantially circular grooves 56" located substantially in the heel region 93 and/or the arch region 92. Further optionally, the grooves can overlap and intersect one another. For example, the elliptical grooves 55" can intersect and overlap at least some of the substantially circular grooves 56". The elliptical grooves 55" can enable the forefoot region 91 of the outsole to flex in a plurality of directions, for example along or across a transverse axis TA and along or across a longitudinal axis LA when the shoe is rolled side to side along the transverse axis TA. Likewise the substantially circular grooves where included can enable the heel region 93 and/or arch region 92 of the outsole of the flex in multiple directions when the shoe is rolled side to side along or across the transverse axis TA.

In the current embodiments, the outsoles can be constructed to be relatively supple, flexible and can have a thickness of optionally about 0.5 mm to about 8 mm, and further optionally about 3 mm to about 5 mm, to allow a child or other wearer to substantially feel the contours of a supporting surface through the outsole, the flexible Strobel board 60 and liner bottom closure 50, while standing and/or walking on a supporting surface. A construction including an outsole including a proprioceptive configuration is believed to allow the footwear 10 to be flexible, pliable, compliant and fit around the geometry of the wearer's foot. In turn, this can allow tactile sensation and proprioceptive feedback of a supporting surface through the footwear 10. The ability to feel the supporting surface through the footwear 10 can enable the wearer to learn to use or enhance their sensory feedback from their feet and aid in development of a proper gait.

A method of manufacturing the footwear will be described with reference to FIGS. 3-9. Generally, the method of manufacturing footwear 10 of the current embodiments can include providing an upper 20 having an upper lowermost peripheral allowance 25. The bottom 26 of the upper 20 is generally open upon its manufacture. A lining 30 is secured to the upper 20, optionally by stitching around the ankle collar 21. Of course, other areas of the lining can be stitched or secured to the interior 14 of the upper 20 as desired. A liner bottom closure is secured to the lining 30. In particular, the liner bottom closure 40 is stitched or otherwise fastened to the lowermost peripheral allowance 45 of the lining 30 to close the liner bottom 36. In this process, the liner bottom closure 40 is not secured to the upper lowermost peripheral allowance 25. Therefore, the upper bottom 26 remains open, rather than closed.

The assembled upper 20, lining 30, and liner bottom closure 40 are then joined with the Strobel board. In particular, the Strobel board 40 is secured directly to the upper lowermost peripheral allowance 25 to close the bottom 26 of the upper 20. When joining the Strobel board with the upper 20, the edges 65E of the Strobel board 60 are generally secured to the edges 25E of the upper along the a common plane P. Where the Strobel board 60 includes apertures 67, 68 the cement 99 can leak therethrough and secure the liner bottom closure to the Strobel board 60. Optionally, the tabs 68T can be folded or moved to apply the cement and secure the lining to the Strobel board as explained above. Generally, the combined thickness T2 (FIG. 9) of the liner bottom closure and Strobel board enables a wearer to perceive movement of the outsole and/or a surface irregularity SI so that the user can be provided with enhanced proprioceptive feedback from the underfoot surface be traversed.

With the Strobel board attached to the upper via the Strobel construction, the components are placed on a last as shown in FIGS. 6 and 7. Generally, when the liner and upper are placed on the last, the last is at least partially if not fully located in the interior 14 of the upper 20. The last can be in the shape of a user's foot and can effectively stretch and configure a lower surface 63 and/or side surfaces 20S of the upper as desired. Accordingly, with the last 95 configuring the upper and Strobel board, cement 99 can be applied as shown in FIG. 8 to the lower surface 63 of the Strobel board 60 as well as part of the sides 20S of the upper, optionally to the upper lowermost peripheral allowance of the upper. With the cement adequately supplied, the outsole 50 can be joined with the upper and Strobel board. Generally, the outsole upper surface 59 engages the lower surface 63 of the Strobel board 60 and secures the outsole thereto as well as to the portions of the side surfaces 20S of the upper 20. The cement 99 is allowed to cure to ensure that the outsole 50 remains securely attached to the above components. After the cement cures, the footwear 10 can be removed from the last 95. From there, the footwear can be finished using conventional trimming, finishing and polishing operations as desired.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

an upper including an interior and an upper bottom, the upper including an upper lowermost peripheral allowance;

a lining secured to the upper and located in the interior of the upper, the lining including a liner bottom and a liner lowermost peripheral allowance;

a liner bottom closure joined with the liner lowermost peripheral allowance to close the liner bottom, without closing the upper bottom, the liner bottom closure including a memory foam core having a face lining;

a flexible Strobel board joined with the upper lowermost peripheral allowance to close the upper bottom with a Strobel construction, the Strobel construction including an edge of the Strobel board stitched to an edge of the upper lowermost peripheral allowance, with the edges substantially in a common plane, the Strobel board having a thickness of between about 0.1 mm to about 1 mm; and an outsole having a forefoot region, a heel region, and an arch region located between the forefoot region and the heel region, the outsole joined with the upper, the outsole constructed from a supple flexible material having a thickness of between about 3 mm to about 5 mm to enable a wearer to feel the contours of a supporting surface through the outsole, the Strobel board, and the liner bottom closure, wherein the liner bottom closure and Strobel board are of a combined thickness that enables a wearer to perceive movement of the outsole, whereby a user is provided with enhanced proprioceptive feedback from a surface being traversed.

2. The article of footwear of claim 1, wherein the outsole includes a base that interconnects a plurality of ground contact pads configured to move relative to one another, each ground contact pad moving substantially independently of the other ground contact pads relative to the base, wherein the liner bottom closure and Strobel board are of a combined thickness that enables a wearer to perceive movement of the plurality of ground contact pads relative to one another.

3. The article of footwear of claim 2 wherein the outsole includes a flex portion at least partially circumscribing each ground contact pad and attaching each ground contact pad to the base.

4. The article of footwear of claim 3 wherein the flex portion defines a substantially corrugated shape having a plurality of undulations, allowing each ground contact pad to move substantially independently of the other relative to the base.

5. The article of footwear of claim 1 wherein the outsole includes a bottom surface that defines a plurality of nested elliptical grooves substantially in the forefoot region, and the bottom surface defines a plurality of nested substantially circular grooves substantially in the heel region, at least some of the elliptical grooves intersecting at least some of the substantially circular grooves.

6. The article of footwear of claim 5 wherein the elliptical grooves allow the forefoot region of the outsole to flex in a plurality of directions when the article of footwear is rolled side to side along a transverse axis, and the substantially circular grooves allow the heel region of the outsole to flex in a plurality of directions when the article of footwear is rolled side to side along the transverse axis.

7. The article of footwear of claim 1 wherein the liner bottom closure is stitched with a first stitching to the liner lowermost peripheral allowance to close the liner bottom, without closing the upper bottom, and wherein the Strobel board is stitched with a second stitching, different from the first, to the upper lowermost peripheral allowance to close the upper bottom.

8. The article of footwear of claim 1 wherein the Strobel board defines an aperture located inward from an outer perimeter of the Strobel board, wherein the aperture is adapted to ensure that the lining remains substantially wrinkle-free even with the Strobel board attached to the upper, wherein the aperture facilitates application of cement between the Strobel board and the liner bottom closure.

9. The article of footwear of claim 8 wherein the liner bottom closure is cemented to an upper surface of the Strobel board.

10. The article of footwear of claim 1, wherein the liner bottom closure is of a thickness in the range of 0.6 mm to 0.8 mm, inclusive.

11. The article of footwear of claim 1, wherein the Strobel board includes a Strobel board lower surface, wherein the lower peripheral allowance includes a lower upper surface, wherein the Strobel board lower surface and the lower upper surface are flush, whereby a clean transition between the Strobel board and lower peripheral allowance reduces wrinkling and buckling when the footwear is flexed.

12. The article of footwear of claim 1, wherein the liner lowermost peripheral allowance is folded to form a flange, wherein the liner bottom closure is stitched to the flange.

13. The article of footwear of claim 1, wherein the thickness of the Strobel board is about 0.7 mm, wherein the liner bottom closure includes another thickness of about 3 mm, wherein the combined thickness of the Strobel board and the thickness of the liner bottom closure enables a wearer to perceive at least one of outsole movement and a surface irregularity underfoot.

14. A method of manufacturing an article of footwear of claim 1 comprising:

providing the upper including the interior and the upper bottom, the upper including the upper lowermost peripheral allowance;

securing the lining to the upper, the lining including the liner bottom and the liner lowermost peripheral allowance;

securing the liner bottom closure to the liner lowermost peripheral allowance to close the liner bottom, without closing the upper bottom;

joining the flexible Strobel board with the upper lowermost peripheral allowance to close the upper bottom, said joining including stitching an edge of the Strobel board to an edge of the upper lowermost peripheral allowance, with the edges laying substantially in a common plane; and placing the lining, upper and joined flexible Strobel board on a last so that the last is at least partially located in the interior of the upper;

joining the outsole with the upper, defining the combined thickness of the liner bottom closure and Strobel board, the combined thickness enabling a wearer to perceive movement of the outsole, whereby a user is provided with enhanced proprioceptive feedback from a surface being traversed.

15. The method of claim 14 comprising cementing the lining to at least one of the upper and the Strobel board.

16. The method of claim 15 comprising defining an aperture in the Strobel board in a location to ensure that the lining is prevented from wrinkling after said joining of the flexible Strobel board with the upper lowermost peripheral allowance, wherein the cement engages the liner bottom closure through the aperture to secure the liner bottom closure to the Strobel board.

17. The method of claim 16 wherein the aperture forms a tab, and comprising folding the tab relative to the Strobel board to access an upper surface of the Strobel board from outside the interior, applying cement to the upper surface of the Strobel board, and moving the tab so that the cement engages the liner bottom closure whereby the liner bottom closure is secured to the Strobel board.

18. The method of claim 14 comprising at least one of:

providing the outsole with a base that interconnects a plurality of ground contact pads configured to move relative to one another, each ground contact pad moving substantially independently of the other ground contact pads relative to the base, and providing the outsole with a bottom surface that defines a plurality of nested elliptical grooves substantially in a forefoot region, the bottom surface defining a plurality of nested substantially circular grooves substantially in a heel region, at least some of the elliptical grooves intersecting at least some of the substantially circular grooves.

19. An article of footwear comprising, an upper including an interior and an upper bottom, the upper including an upper lowermost peripheral allowance;

a lining secured to the upper and located in the interior of the upper, the lining including a liner bottom and a liner lowermost peripheral allowance;

a liner bottom closure joined with the liner lowermost peripheral allowance to close the liner bottom, without closing the upper bottom;

a flexible Strobel board joined with the upper lowermost peripheral allowance to close the upper bottom with a Strobel construction, the Strobel construction including an edge of the Strobel board stitched to an edge of the upper lowermost peripheral allowance, with the edges substantially in a common plane;

an outsole having a forefoot region, a heel region, and an arch region located between the forefoot region and the heel region, the outsole joined with the upper, wherein the liner bottom closure and Strobel board are of a combined thickness that enables a wearer to perceive movement of the outsole, whereby a user is provided with enhanced proprioceptive feedback from a surface being traversed, wherein the outsole includes a base that interconnects a plurality of ground contact pads configured to move relative to one another, each ground contact pad moving substantially independently of the other ground contact pads relative to the base, wherein the liner bottom closure and Strobel board are of a combined thickness that enables a wearer to perceive movement of the plurality of ground contact pads relative to one another, wherein the Strobel board is attached to the plurality of ground contact pads while remaining substantially unattached to the base that interconnects the plurality of ground contact pads, allowing the Strobel board to move with the ground contact pads unimpeded by substantial non-movement of the base.

* * * * *